US005499302A

United States Patent [19]

Nagami et al.

[11] Patent Number: 5,499,302

[45] Date of Patent: Mar. 12, 1996

[54] NOISE CONTROLLER

[75] Inventors: Masaaki Nagami, Akashi; Kazuya Sako, Kakogawa; Masahiro Babasaki, Takatsuki; Kazuhiro Sakiyama, Akashi, all of Japan

[73] Assignee: Fujitsu Ten Limited, Hyogo, Japan

[21] Appl. No.: 455,138

[22] Filed: May 31, 1995

Related U.S. Application Data

[63] Continuation of Ser. No. 66,428, May 25, 1993, abandoned.

[30] Foreign Application Priority Data

May 26, 1992 [JP] Japan ..... 4-133686
May 26, 1992 [JP] Japan ..... 4-133737

[51] Int. Cl.[6] ..... G10K 11/16
[52] U.S. Cl. ..... 381/71
[58] Field of Search ..... 381/71, 94

[56] References Cited

U.S. PATENT DOCUMENTS

| | | | |
|---|---|---|---|
| 4,677,676 | 6/1987 | Eriksson | 381/71 |
| 4,783,818 | 11/1988 | Graupe et al. | 381/71 |
| 5,022,082 | 6/1991 | Eriksson et al. . | |
| 5,105,377 | 4/1992 | Ziegler, Jr. | 381/71 |

FOREIGN PATENT DOCUMENTS

| | | | |
|---|---|---|---|
| 0410685 | 1/1991 | European Pat. Off. | 381/71 |
| 62-20713 | 1/1987 | Japan . | |
| 2-218297 | 8/1990 | Japan . | |
| 3-203493 | 9/1991 | Japan . | |
| 3-203492 | 9/1991 | Japan . | |
| 3-203490 | 9/1991 | Japan . | |
| 03259722 | 11/1991 | Japan | 381/71 |
| 5046186 | 2/1993 | Japan . | |
| 63-311396 | 9/1994 | Japan . | |
| 2259831 | 3/1993 | United Kingdom . | |
| 88/02912 | 4/1988 | WIPO . | |

*Primary Examiner*—Forester W. Isen
*Attorney, Agent, or Firm*—Oliff & Berridge

[57] ABSTRACT

In a noise controller which forms a noise cancelling sound having a phase opposite to and a sound pressure equal to those of a noise infiltrating into a closed space, any deviation in its transfer characteristics from the initial equalization is easily checked and judged owing to the provision of an adaptive filter which automatically varies the filter coefficient and forms a cancelling signal for forming a cancelling sound, a coefficient updating means which updates the filter coefficient based on an error signal after the noise has been cancelled, a simulated transfer characteristics compensation means which forms the initial equalization by simulating transfer characteristics of a transmission path via the space in which the noise is to be cancelled and forms a reproduced reference signal, a white noise generating means which generates white noise to check the initial equalization, and an initial equalization judging means which judges the accuracy of the initial equalization based on a ratio (S/N) of the reproduced reference signal obtained from white noise to the error signal. A change in the conditions for cancelling noise is detected in the closed space, and any deviation from the initial equalization is judged.

13 Claims, 9 Drawing Sheets

NOISE CONTROLLER

This is a continuation of application Ser. No. 08/066,428 filed May 25, 1993, now abandoned.

BACKGROUND OF THE INVENTION

1. Field of the Invention

The present invention relates to a noise controller which cancels noise by outputting from a speaker a noise cancelling sound having a phase opposite to and a sound pressure equal to those of noise produced by an engine, a motor or the like. More specifically, the invention relates to judging any deviation from initial equalization-forming conditions that compensate for the attenuation of frequency bands and the transfer characteristics caused by the delay of propagation time in the transmission path of the noise controller.

2. Description of the Prior Art

Passive silencing devices such as mufflers and the like have heretofore been used to reduce the noise generated from internal combustion engines and the like needing, however, improvements from the standpoint of size and silencing characteristics. There has, on the other hand, been proposed an active noise controller which cancels the noise by outputting from a speaker a noise cancelling sound having a phase opposite to and a sound pressure equal to those of the noise generated from the source of sound. However, the active noise controller was not readily put into practical use because it lacked certain frequency characteristics and stability. In recent years, however, there have been proposed many practical noise controllers along with developments in the technology for processing digital signals and in the art for handling wide ranges of frequencies (see, for example, Japanese Unexamined Patent Publication (Kokai) No. 63-311396).

A digital signal processor (DSP) in the conventional noise controller uses an adaptive filter of the FIR (finite impulse response) type which forms a signal for cancelling noise upon receiving a reference signal which is a signal to be controlled, detects a residual sound which is the result of cancellation, and performs a feedback control using the residual sound as an error signal such that the level of the residual sound is minimized. In this feedback control, furthermore, the level of the error signal can be minimized by controlling the filter coefficient of the adaptive filter. The reference signal applied to the adaptive filter can be obtained by synthesizing the noise cancelling signal formed by itself and the error signal that is detected.

Here, the noise controller uses a speaker for producing a noise cancelling sound and a microphone for detecting an error signal, and space through which sound waves propagate exists between the speaker and the microphone. Therefore, frequency bands are attenuated and the propagation time is delayed for the relevant transmission band. Compensating for the transmission characteristics in the transmission band is generally called initial equalization. The processing of initial equalization is carried out to form a filter coefficient of the adaptive filter.

However, there remains a first problem in that if the speaker, microphone and the like constituting the noise controller become defective or deteriorate, the accuracy of the initial equalization becomes extremely poor, and the effect of noise control is not obtained to a sufficient degree.

In view of the above-mentioned problem, therefore, it is an object of the present invention to provide a noise controller which is capable of judging a decrease in accuracy of the initial equalization at an early stage.

There further remains a second problem in that when the noise controller is used under different conditions from the space in which it was originally installed, the initial equalization deviates from the preset initial equalization, and abnormal operation occurs if the noise controller is used under this condition.

In view of the above-mentioned problem, therefore, the object of the present invention is to provide a noise controller which is capable of judging whether the initial equalization is proper or not in response to a change in the conditions in which the noise controller is used.

SUMMARY OF THE INVENTION

In order to solve the above-mentioned problems, the present invention provides a noise controller which forms a noise cancelling sound having a phase opposite to and a sound pressure equal to those of a noise, comprising an adaptive filter which inputs a criterion of a noise signal that is a signal to be controlled, varies the filter coefficient to cancel the noise, and forms a noise cancelling signal to produce said noise cancelling sound; a coefficient updating means which updates the filter coefficient of the adaptive filter in order to minimize an error signal after the noise is cancelled; a first simulated transfer characteristics compensation means which forms the initial equalization by simulating transfer characteristics of a transmission path from the output of the adaptive filter through to an input of the coefficient updating means via a space in which the noise is to be cancelled, and provides the initial equalization for a standard signal relating to the noise which is input to the coefficient updating means; a white noise generating means which generates white noise to check the initial equalization by using the white noise instead of the criterion noise signal; and an initial equalization judging means which judges the accuracy of the initial equalization based on a ratio of an error signal Sm obtained via the transmission path of a cancelled space by the white noise signal are produced signal Se obtained by synthesizing the output signal of the adaptive filter and the error signal Sm relating to the white noise.

According to the noise controller of the present invention, a white noise signal from the white noise generating means is used by the initial equalization judging means as a criterion for the noise signal. When the speaker, microphone and the like are normal, the reproduced reference signal and an error signal are input, and their ratio under normal conditions is measured in advance and is stored. Thereafter, the white noise generating means is actuated while maintaining a predetermined time internal, the ratio of the reproduced reference signal to the error signal is found as mentioned above and is compared with the ratio under the normal conditions every time the ratio is measured. Thus, the accuracy of the initial equalization is checked and the result of checking is indicated. In case the noise controller itself, the speaker, the microphone or the like becomes defective, therefore, the accuracy of the initial equalization is extremely deteriorated which according to the present invention can be easily judged. Concretely, the accuracy of the initial equalization can be judged more correctly by employing, as the white noise generating means, a swept sinusoidal wave in the case when the noise contains a sinusoidal wave, a higher harmonics sweep in the case when the noise includes higher harmonics, an impulse generator in the case when the noise is impulsive, or a storage means which stores the noise and outputs the noise signal that is stored. Moreover, the initial equalization judging means expresses the two input signals, i.e., the error signal and the criterion noise signal in the form of a mutually correlated function, compares a time difference between the two signals with a predetermined time and judges the decrease in the accuracy of the initial equalization, to thereby more correctly judge the accuracy of the initial equalization. Moreover, the noise controller is equipped with a variable amplifier means which variably controls the output level of the white noise generating means and a noise level detector means which detects the level of the error signal and causes the variable amplifier means to control its amplification depending upon the noise level, making it possible to judge the accuracy of the initial equalization even under noisy conditions. The simulated transfer characteristics compensation means simulates the transfer characteristics from the output of the adaptive filter up to the input of the coefficient updating means replying on noise signals and signals from the white noise generating means, and compensates the normalized criterion noise signal by using an average value of the simulated transfer characteristics, to make it possible to correctly judge the initial equalization even when noise exists.

Next, a noise controller which forms a cancelling sound having a phase opposite to and a sound pressure equal to those of a noise infiltrating into a closed space, comprises an adaptive filter which inputs a criterion noise signal, automatically varies the filter coefficient to cancel the noise, and forms a cancelling signal to form the cancelling sound; a coefficient updating means which updates the filter coefficient of the adaptive filter based on an error signal after the noise has been cancelled; a simulated transfer characteristics compensation means which forms the initial equalization by simulating transfer characteristics of a transmission path from the output of the adaptive filter up to the input of the coefficient updating means via a space in which the noise is to be cancelled, and provides the initial equalization for a standard signal relating to the noise which is input to the coefficient updating means; and an initial equalization change detector means which detects a change in the initial equalization and ceases the generation of the opposite phase and the equal sound pressure in order to preclude operation which is different from that under the condition where the simulated transfer characteristics compensation means are subjected to the initial equalization.

According to the noise controller of the present invention, a change in the initial equalization is detected by the initial equalization change detector means, and the opposite phase and the equal sound pressure are no longer generated in order to preclude operation which is different from that under the condition of the initial equalization. Therefore, when the noise controller is used under different conditions, any deviation from the initial equalization is detected and operation of the noise controller is stopped, thereby preventing the occurrence of abnormal operation. Concretely speaking, in order to detect the conditions of different transfer characteristics, provision is made of a window open/close detector as the above-mentioned initial equalization change detector means which detects whether a window of the closed space is opened or is closed, and detects a change in the initial equalization when the window is opened. Provision is further made of a noise level detector which detects the noise level in the closed space and detects a change in the initial equalization when the noise level is smaller than a predetermined range, in order to detect the condition where the noise level is so low that the noise controller does not need to be operated. Thus, the sound produced by wind whistle which is not the target sound is detected making it possible to prevent erroneous operation. Moreover, provision is made of a noise band level detector which detects the noise level of a desired frequency band only within the closed space and detects a change in the initial equalization when the noise level of the designed frequency band is greater than a predetermined range, making it possible to detect the cause of erroneous operation in a low-frequency zone where the microphone exhibits a low output efficiency and in a high-frequency zone that is difficult to cancel. Provision is made of a vibration level detector which detects vibration that is a cause of noise in the closed space and detects a change in the initial equalization when the vibration level of a desired vibration frequency is greater than a predetermined range. This is because, since vibration of the engine, motor or the like can be directly measured, it is possible to detect the frequency without being affected by the speaker. When the closed space is moving, furthermore, the speed is detected. When this speed is without a predetermined range, a speed detector detects a change in the initial equalization in order to detect the sound produced by wind whistle which is not the target sound.

DESCRIPTION OF THE PREFERRED EMBODIMENTS

Figure 1:
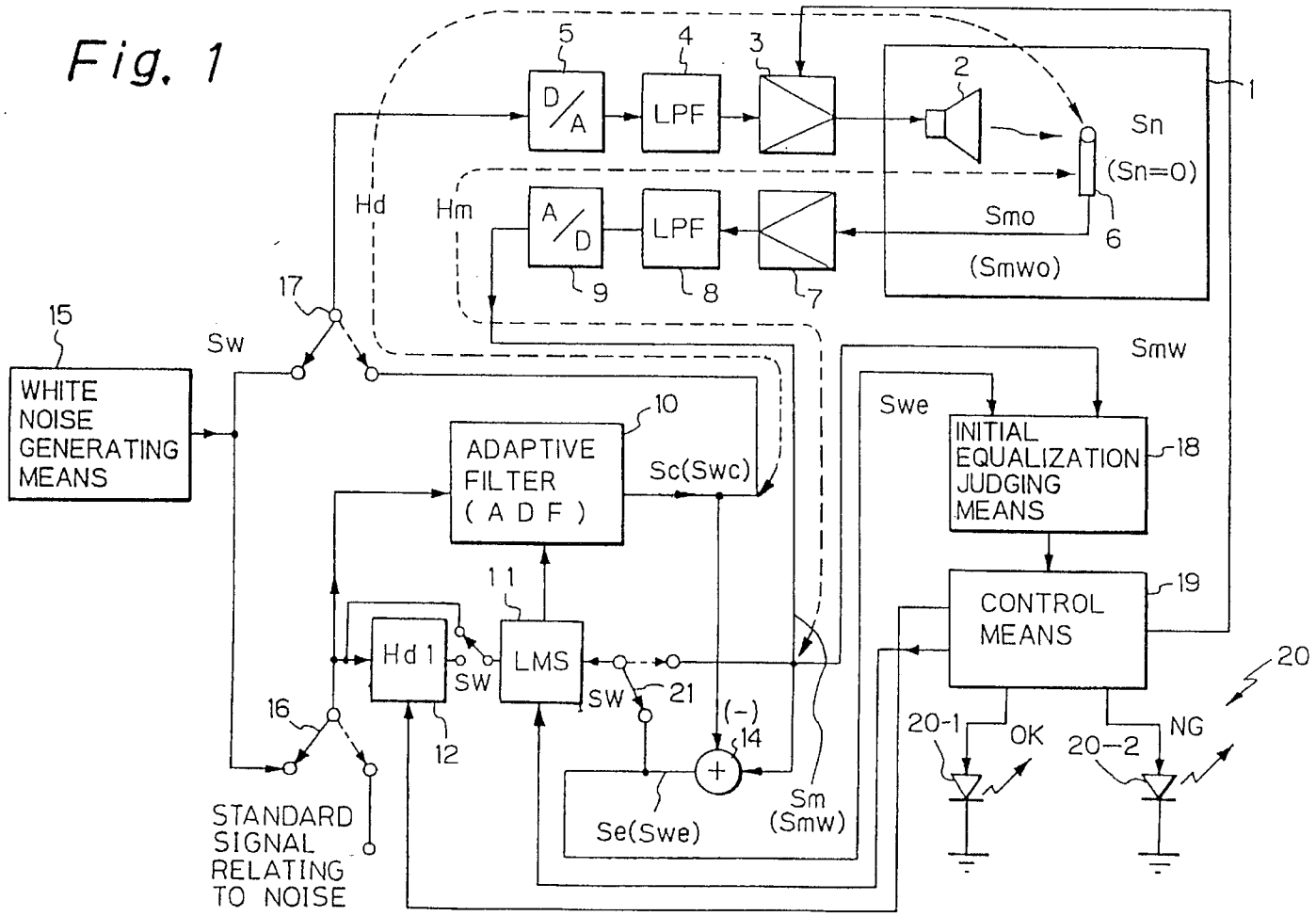
FIG. 1 is a diagram illustrating a noise controller according to a first embodiment of the present invention.

FIG. 1 is a diagram illustrating a noise controller according to a first embodiment of the present invention. The noise controller shown here is equipped with a speaker which is installed in a closed space 1 in which the noise is to be cancelled and which outputs a noise cancelling sound having a phase opposite to and a sound pressure equal to those of the noise to be cancelled, a power amplifier 3 which drives the speaker 2, a low-pass filter 4 which outputs to the power amplifier 3, an analog signal (high-frequency components are removed from analog signal), a D/A converter 5 (digital-to-analog converter) which converts a digital signal into an analog signal and outputs it to the low-pass filter 4, a microphone 6 which detects as an error signal the residual sound that remains after the noise is cancelled by the speaker 2, an amplifier 7 which amplifies a signal from the microphone 6, a low-pass filter 8 which removes high-frequency components of the amplified signal in order to prevent the generation of reflected signals, an A/D converter 9 (analog-to-digital converter) which converts the analog signal from which the high-frequency components have been removed into a digital signal, an adaptive filter 10 of the FIR type which outputs a cancelling signal to the D/A converter 5, and a coefficient updating means 11 which updates the filter coefficient of the adaptive filter 10 in response to the error signal from the A/D converter 9 and a reproduced reference signal Se (reproduced noise signal) that will be described later. The noise controller further includes a first simulated transfer characteristics compensation means 12 consisting of an FIR filter which sets the initial equalization by simulating the transfer characteristics of a transmission path from the output of the adaptive filter 10 through to the input of the coefficient updating means 11 via the speaker 2, microphone 1 and the like, and forms a reproduced reference signal by synthesizing said cancelling signal and the error signal together, a differential signal calculation means 14 which calculates a difference between output signals from the A/D converter 9 and the adaptive filter 10, a white noise generating means 15 which generates white noise signal for checking the accuracy of the initial equalization, a switching means 16 which alternatively selects the output of the white noise generating means 15 or a standard signal relating to the noise which is input to the coefficient updating means 11, a switching means 17 which alternatively selects the output of the adaptive filter 10 or the output of the white noise generating means 15 being interlocked to the switching means 16 and outputs it to the D/A converter 5, an initial equalization judging means 18 which, when the switching means 16 has selected the white noise generating means 15 to establish the initial equalization mode, inputs the reproduced reference signal from the differential signal calculation means 14 and the error signal from the A/D converter 9, finds a ratio S/N thereof, and compares it with a predetermined value to judge the accuracy of the initial equalization, a control means 19 which controls the muting for the power amplifier 3, controls the coefficient of the coefficient updating means 11, and controls the transfer characteristics of the first simulated transfer characteristics compensation means 12 based on the judgement of the initial equalization judging means 18, an indicator unit 20 which indicates whether the accuracy of the initial equalization judged by the initial equalization judging means 18 satisfies a predetermined value or not, and a switching means 21 which alternatively selects the output of the A/D converter 9 or the output of the differential signal calculation means 14 being interlocked to the switching means 16 and outputs it to the coefficient updating means 11. The indicator unit 20 is equipped with an OK lighting means 20-1 which turns on when the accuracy of the initial equalization satisfies a predetermined value and an NG lighting means 20-2 which turns on when the accuracy of the initial equalization fails to satisfy the predetermined value.

Figure 2:
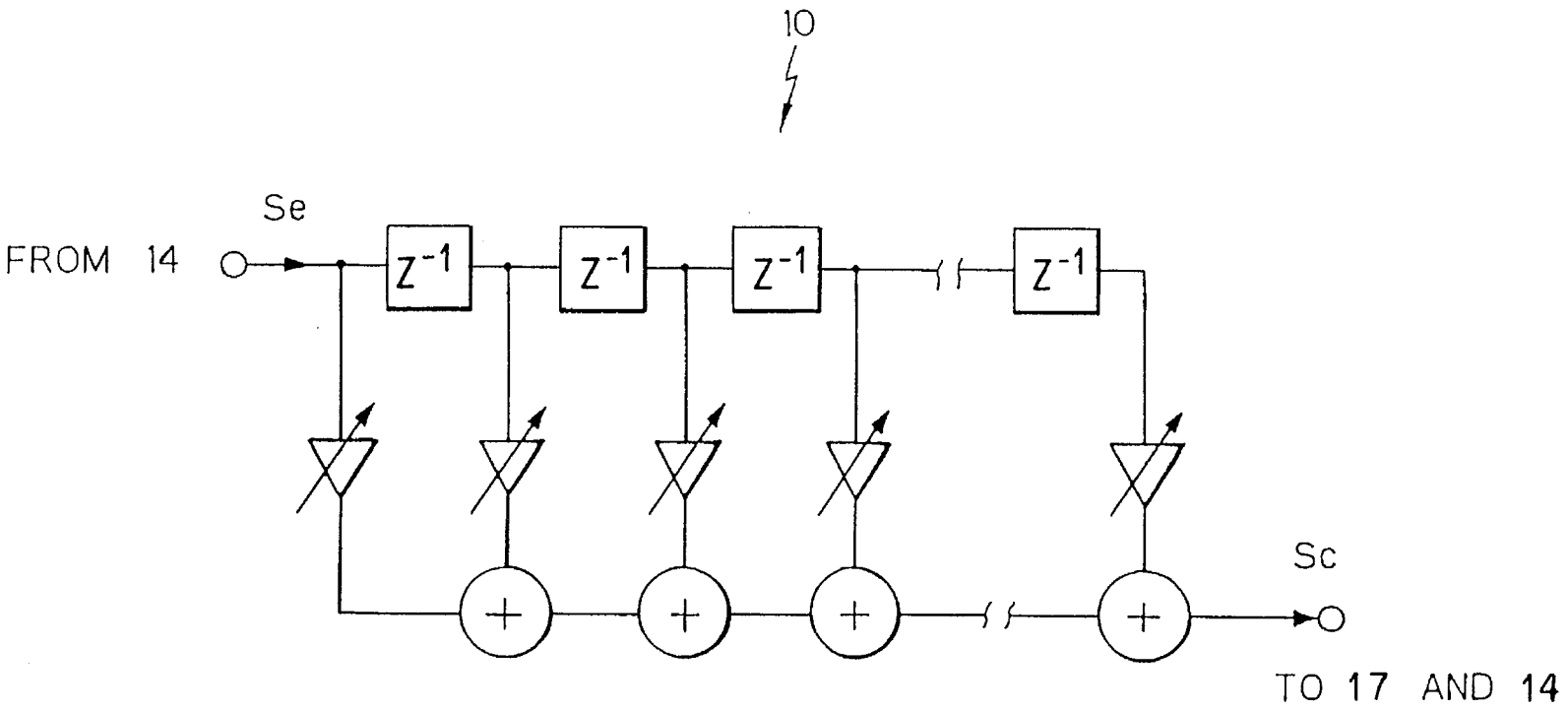
FIG. 2 is a diagram illustrating the constitution of an adaptive filter 10 of FIG. 1.
Figure 3:
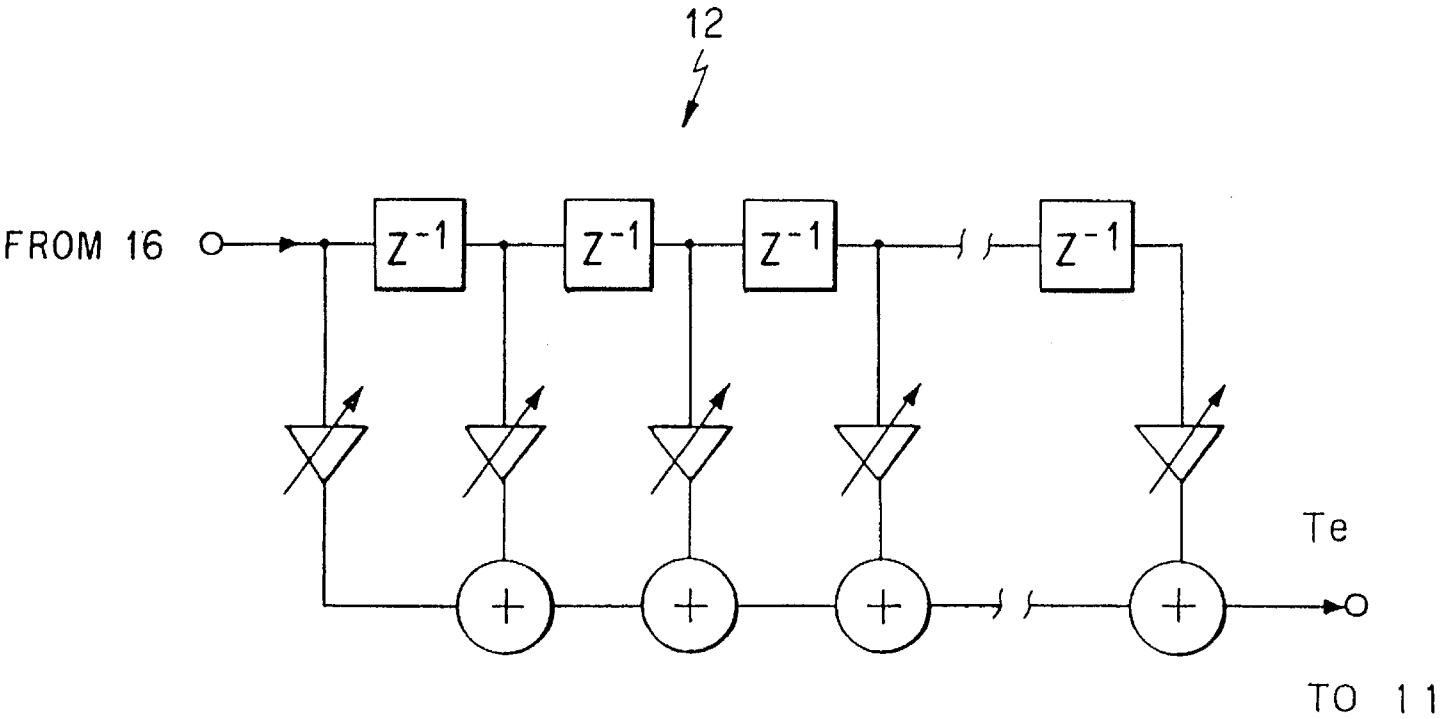
FIG. 3 is a diagram illustrating the constitution of first simulated transfer characteristics compensation means 12 of FIG. 1.

FIG. 2 is a diagram illustrating the constitution of the adaptive filter 10, and FIG. 3 is a diagram illustrating the constitution of the first simulated transfer characteristics compensation means 12. The filter coefficient of FIG. 2 is updated by the coefficient updating means 11. The filter coefficient of the first simulated transfer characteristics compensation means 12 of FIG. 3 is controlled by the control unit 19. The coefficient updating means 11 forms a filter coefficient of the adaptive filter 10 in response to an error signal from the A/D converter 9 and a compensation signal obtained by compensating the reproduced reference signal from the differential signal calculation means 14 through the first simulated transfer characteristics compensation means 12 in compliance with an equation (6) appearing later. The aforementioned noise controller is a feedback system which reproduces a reproduced reference signal by synthesizing the error signal and the cancelling signal from the adaptive filter 10. Here, however, a criterion noise signal Swe may be directly output to the initial equalization judging means 18 from the white noise generating means 15.

Described below is a noise reproducing signal Se output from the differential signal calculation means 14. Here, if the sound pressure of noise is denoted by Sn, the error signal output by the microphone 6 is denoted by Smo, the input signal to the coefficient updating means 11 by Sm, the cancelling signal output from the adaptive filter 10 by Sc, the transfer characteristics from the output of the adaptive filter 10 up to the microphone 6 by Hd, and the transfer characteristics from the microphone 6 to the filter coefficient updating means 11 are denoted by Hm, then the input signal to the coefficient updating means 11 is expressed as $$Sm=Smo\cdot Hm \tag{1}$$

The transfer characteristics Hd1 simulated by the first transfer characteristics simulating means 12 and the second transfer characteristics simulating means 13 are expressed as $$Hd1=Hd\cdot Hm \tag{2}$$

and the signal Smo detected by the microphone 6 is expressed as $$Smo=Sn+Sc\cdot Hd \tag{3}$$

From the above equation (1), (2) and (3), the differential signal Se which is a reproduced reference signal input to the adaptive filter 10 and the like and is a result of calculation by the differential signal calculation means 14, is given as follows:

$$\begin{aligned} Se &= Sm - Sc\cdot Hd1 \\ &= Smo\cdot Hm - Sc\cdot Hd1 \\ &= (Sn + Sc\cdot Hd)\cdot Hm - Sc\cdot Hd\cdot Hm \\ &= (Sn + Sc\cdot Hd - Sc\cdot Hd)\cdot Hm \\ &= Sn\cdot Hm \end{aligned} \tag{4}$$

In the adaptive filter 10, the filter coefficient of FIG. 2 is so changed that the input signal Sm to the coefficient updating means 11 becomes zero. Therefore, since Sm=0, i.e., Smo=0, the cancelling signal Sc output from the adaptive filter 10 is now determined from the equation (3) as follows:

$$Sc=-Sn/Hd \tag{5}$$

In this case,the filter coefficient of FIG. 2 is updated by the coefficient updating unit 11 in compliance with the following equation, $$Ck(n+1)=Ck(n)\cdot C1+\alpha C2\cdot Te(n)\cdot Sm(n) \tag{6}$$

where Sm(n) denotes an error signal, α denotes a convergence coefficient, Te(n) denotes a reproduced noise signal subjected to the initial equalization, n is an ordinal number, and C1 and C2 are usually "1", respectively, but are set to predetermined values that will be mentioned later, by the control unit 19.

Next, described below is the formation of simulated transfer characteristics of the first simulated transfer characteristics compensation means 12.

Figure 4:
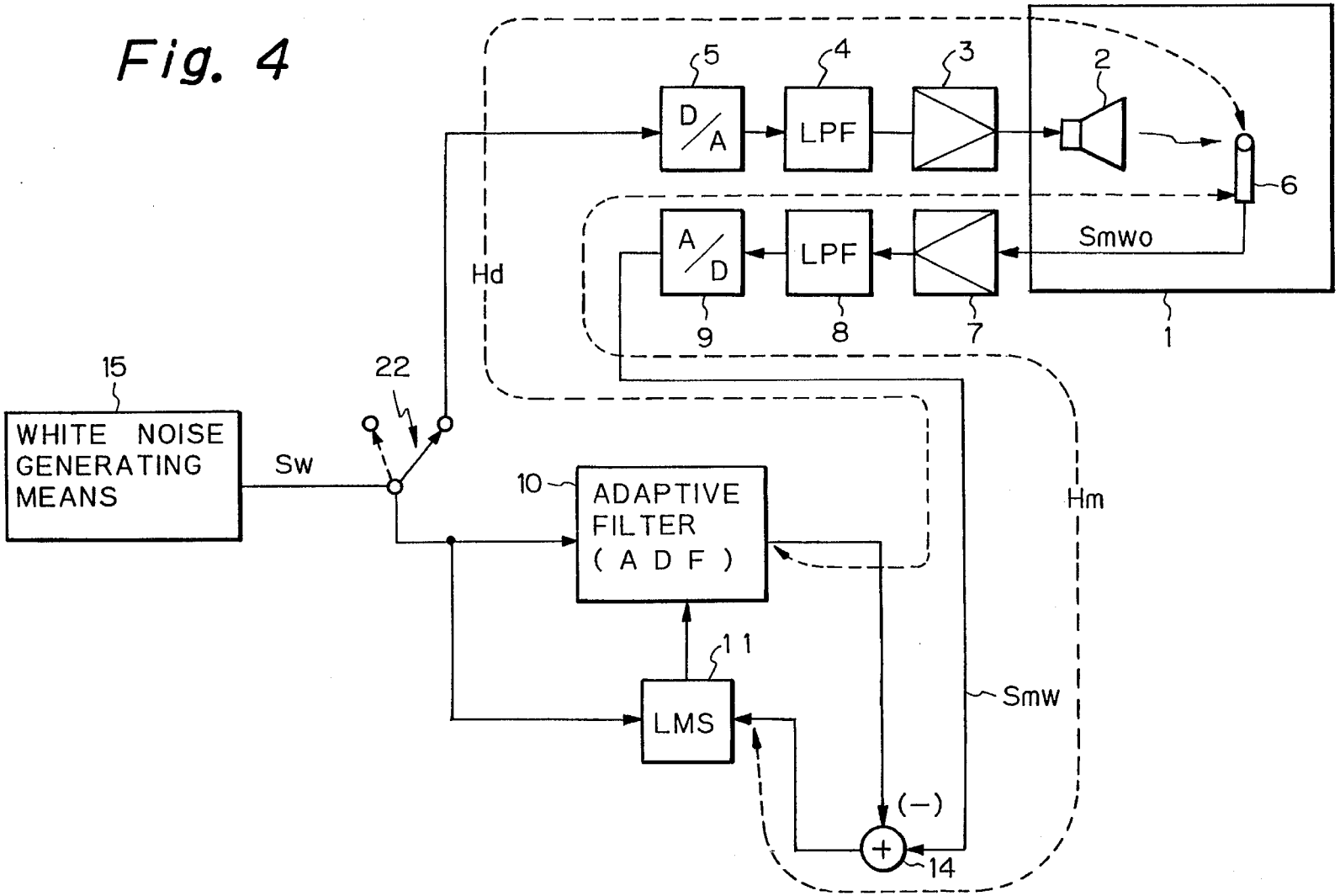
FIG. 4 is a diagram illustrating the constitution of a noise controller which sets simulated transfer characteristics of the first simulated transfer characteristics compensation means 12 of FIG. 1.

FIG. 4 is a diagram illustrating the constitution for setting the simulated transfer characteristics of the transfer characteristics simulation means 12 of FIG. 1. First, under the condition where there is no noise in the closed space 1, white noise is output to the D/A converter 5 from the white noise generating means 15 via the switch means 22, but the output to the D/A converter 5 from the adaptive filter 10 is interrupted by the switching means 23. The adaptive filter 10 so adjusts the transfer characteristics that the signal Swe from the differential signal calculation means 14 becomes zero. This adjustment is accomplished by adjusting the filter coefficient of the FIR filter of FIG. 3. Here, from the equation (5), if $$\begin{aligned} Swe &= Smw - Sw \cdot Hd1 \\ &= 0 \end{aligned} \tag{7}$$

for the white noise Sw from the white noise generating means 15, where Smw denotes an input signal to the coefficient updating means 11 due to white noise, then the simulated transfer characteristics Hd1 are obtained to be, $$Hd1 = Smw/Sw \tag{8}$$

Thus, the filter coefficients of the FIR filters in the first transfer characteristics simulating means 12 of FIG. 3 are determined and are subjected to the initial equalization. It is possible to measure the filter coefficient and to preserve it to cope with the aging of the speaker 2 and the microphone 6. When the conditions in the closed space 1 become different, the initial equalization becomes correspondingly different. This makes it possible to preserve the filter coefficients subjected to the initial equalization depending upon the above-mentioned conditions.

Described below is the process of judging whether the initial equalization by the initial equalization judging means 18 of FIG. 1 is proper or not under the initial equalization conditions of the first transfer characteristics simulation means 12 found as described above. When, for example, the noise controller is started from its inoperative condition as shown in FIG. 1 the input terminals of the D/A converter 5 and the adaptive filter 10 are connected to the white noise generating means 15 by the switching means 16 and 17 without generating noise. At this moment, the initial equalization judging means 18 finds the S/N as described below to evaluate the accuracy of the initial equalization. No noise signal exists here, and the output of the differential signal calculation means 14 is denoted by Swe, the error signal output from the microphone 6 is denoted by Smwo, the input signal to the coefficient updating means 11 is denoted by Smw, and the cancelling signal output from the adaptive filter 10 is denoted by Swc. Here, the S/N is defined to be, $$\begin{aligned} S/N &= |Smw/Swe| \\ &= |Smw/(Smw - Swc \cdot Hd1)| \\ &= |1/\{(1 - (Swc/Smw) \cdot Hd1)\}| \end{aligned} \tag{9}$$

In FIG. 2, the value S/N is denoted as $(S/N)_0$ immediately after the simulated transfer characteristics Hd1 of the first simulated transfer characteristics compensation means 12 are set, i.e., the value S/N is denoted as $(S/N)_0$ under the condition where the speaker 2, microphone 6 and the like are all right, and a criterion value obtained by multiplying this value by a safety coefficient a is found to be $a \times (S/N)_0$, $(a<1)$, and is stored.

Next, when a predetermined period of time has passed from the setting, the initial equalization judging means 18 finds the S/N ratio in compliance with the equation (10) and compares it with a criterion value of equation (11).

When, $$S/N \geqq a \times (S/N)_0 \tag{10}$$

it is so judged that the parts constituting the noise controller are not defective and the initial equalization has been properly set. Accordingly, the control unit 19 causes the OK lighting means 20-1 to be turned on the indicate a normal judgment.

On the other hand, when, $$S/N < a \times (S/N)_0 \tag{11}$$

it is judged that the parts constituting the noise controller are defective and the initial equalization has no longer been properly set. Then, the control unit 19 causes the NG lighting means 20-2 to be turned on the indicate an abnormal judgment. This facilitates the treatment and judgment such as replacing the constituent parts.

It is allowable to keep the noise controller of the constitution of FIG. 4 in use by accomplishing again the initial equalization of the first simulated transfer characteristics compensation means 12 in the deteriorated condition until the deteriorated speaker 2 and microphone 6 are replaced by new ones.

In the above-mentioned case, furthermore, muting of the power amplifier 3 may be effected via the control unit 19 to halt the noise control.

In the above-mentioned case, moreover, the filter coefficient of the above equation (6) and the convergence coefficients C1, C2<<1 may be set to the coefficient updating unit 11 via the control unit 19, in order to lower the noise control gain. This places the noise controller virtually in an inoperative condition.

In the above description, the speaker 2 and the microphone 6 have deteriorated suddenly. The speaker and the microphone, however, may deteriorate gradually. The filter coefficient shown in FIG. 3 for the corresponding initial equalization may be stored in advance in the control unit 19 to meet the condition of deterioration, and the filter coefficient of the first simulated transfer characteristics compensation means 12 may be updated upon properly judging the initial equalization, so that the S/N becomes the greatest.

It is allowable to employ a higher harmonics generating means using a higher harmonics sweep instead of using the sinusoidal wave generating means. When the noise waves are close to higher harmonics, physical characteristics of the microphone 6 and the like can be equalized more correctly.

There may further be employed an impulse generating means which uses an impulse sound source instead of using the higher harmonics generating means. When the noise waves are close to impulses, physical characteristics of the microphone 6 and the like can be equalized more correctly.

Instead of using the impulse generating means, there may be employed a memory noise generating means which stores noise and generates the stored noise as criterion signals. The memory noise generating means is constituted by a RAM (random access memory) and stops producing the cancelling sound from the speaker 1 to store the noise; i.e., the noise is stored in the memory noise generating means via the microphone 5 and the A/D converter 8. The memory noise generating means produces output via the switching means 15 in the same manner as described above. Equalization with sound closer to that of the noise source makes it possible to accomplish the equalization more correctly.

Described below is another constitution of the initial equalization judging means 18. The abovementioned initial equalization judging means 18 finds the S/N ratio from the equation (10). Here, however, a time delay is measured between the output signal Swe of the differential signal calculation means 14 and the output signal Smw of the A/D converter 9, and the accuracy of the initial equalization is judged by the initial equalization judging means 18-1 by using a mutually correlated function. The initial equalization judging means 18-1 expresses a mutually correlated function Rxy(τ) of two signals x(t) and y(t) as given by the following equation, $$Rxy(\tau) = \lim_{T\to\infty}(1/T)\int_0^T x(\tau)y(t+\tau)dt \quad (12)$$

where T denotes an observation time and τ denotes a time difference of a random time history memory, i.e., τ at which a peak develops in the mutually correlated function denotes a delay time of the system.

Therefore, the two signals Swe and Smw correspond to the above two signals x(t) and y(t), a reference delay time τ0 is set in advance for the delay time τ, and the judgement is so rendered that the accuracy of the initial equalization is deteriorated when the delay time is greater than the above reference delay time.

Figure 5:
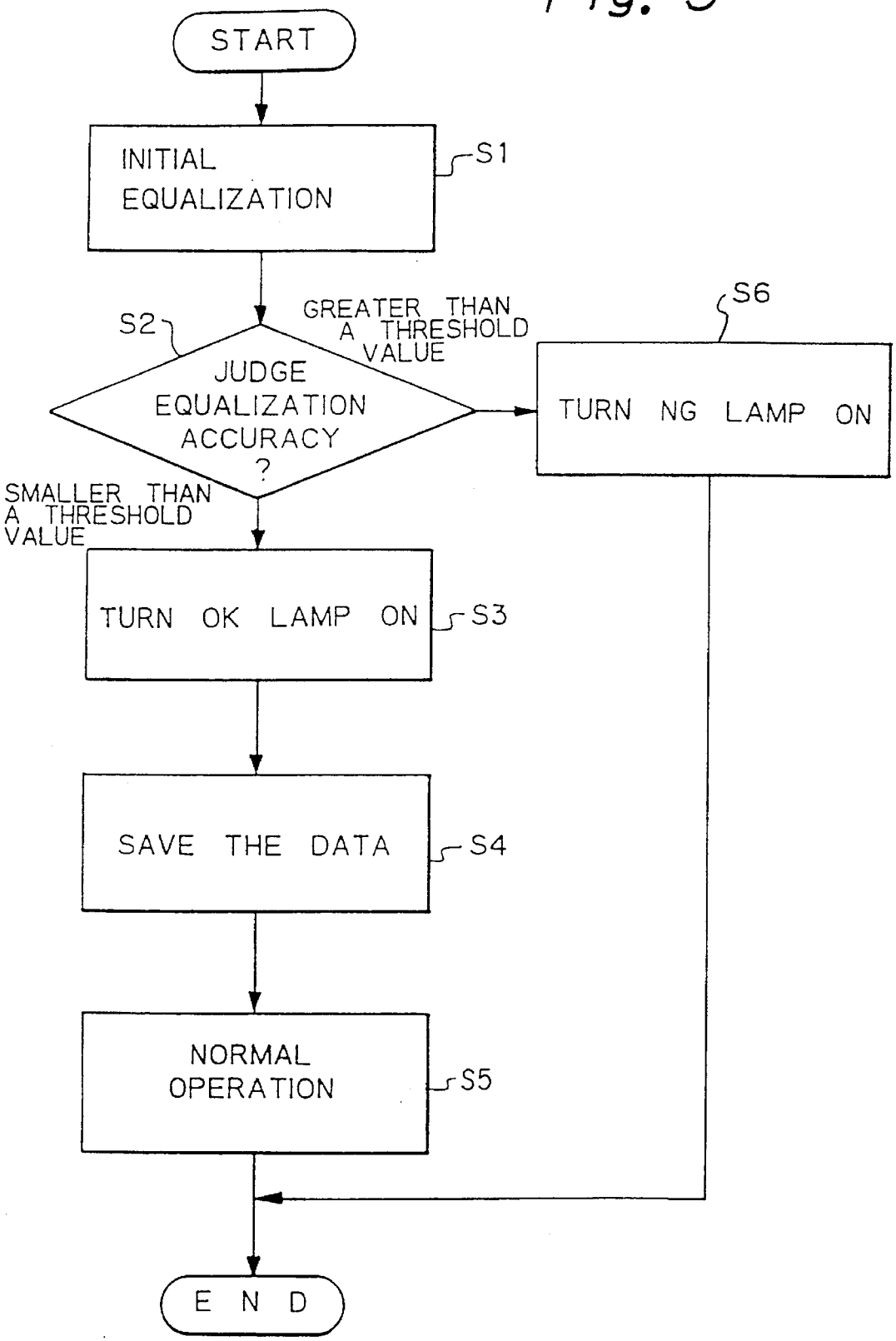
FIG. 5 is a flowchart explaining a series of operations according to the first embodiment.

FIG. 5 is a flowchart explaining a series of operations according to the first embodiment. As shown in this diagram, a step 1 effects the initial equalization when the noise controller is started. As shown in FIG. 4, therefore, the initial equalization mode is selected by the switching means 22 and 23. Thus, simulated transfer characteristics are set in the first simulated transfer characteristics compensation means 12.

A step 2 changes the switching means 16, 17 and 21 of FIG. 1 over to the equalization accuracy judging mode. Relying upon the output signal Smw of the A/D converter 9 and the output signal Swe of the differential signal calculation means 14, the initial equalization judging means 18 finds the accuracy of the initial equalization by the aforementioned method. It is judged whether the accuracy of the initial equalization is greater than a predetermined threshold value or not.

When the accuracy of the initial equalization is smaller than the threshold value, this means that the parts constituting the noise controller are normal, and a step 3 causes the OK lighting means 20-1 to turn the OK lamp on.

A step 4 stores the data obtained through the initial equalization in a memory means that is not shown so that it can be used for tracing the aging.

A step 5 changes the switching means 16, 17 and 21 of FIG. 1 over to the normal operation mode to carry out the noise control.

When the accuracy of equalization is greater than the predetermined threshold value in the step 2, a step 6 causes the NG lighting means 20-2 to indicate defective condition. This makes it possible to replace defective parts such as the speaker 2, microphone 6 and the like by new ones, or to take a measure such as newly finding simulated transfer characteristics of the first simulated transfer characteristics compensation means 12 to accomplish the initial equalization again. The aforementioned initial equalization and judgement of the accuracy thereof must be effected even under noisy conditions. However, the initial equalization cannot be sufficiently accomplished and its accuracy cannot be judged when there are noise signals included in addition to criterion signal from the white noise generating means 15. Described below is a case where noise exists.

Figure 6:
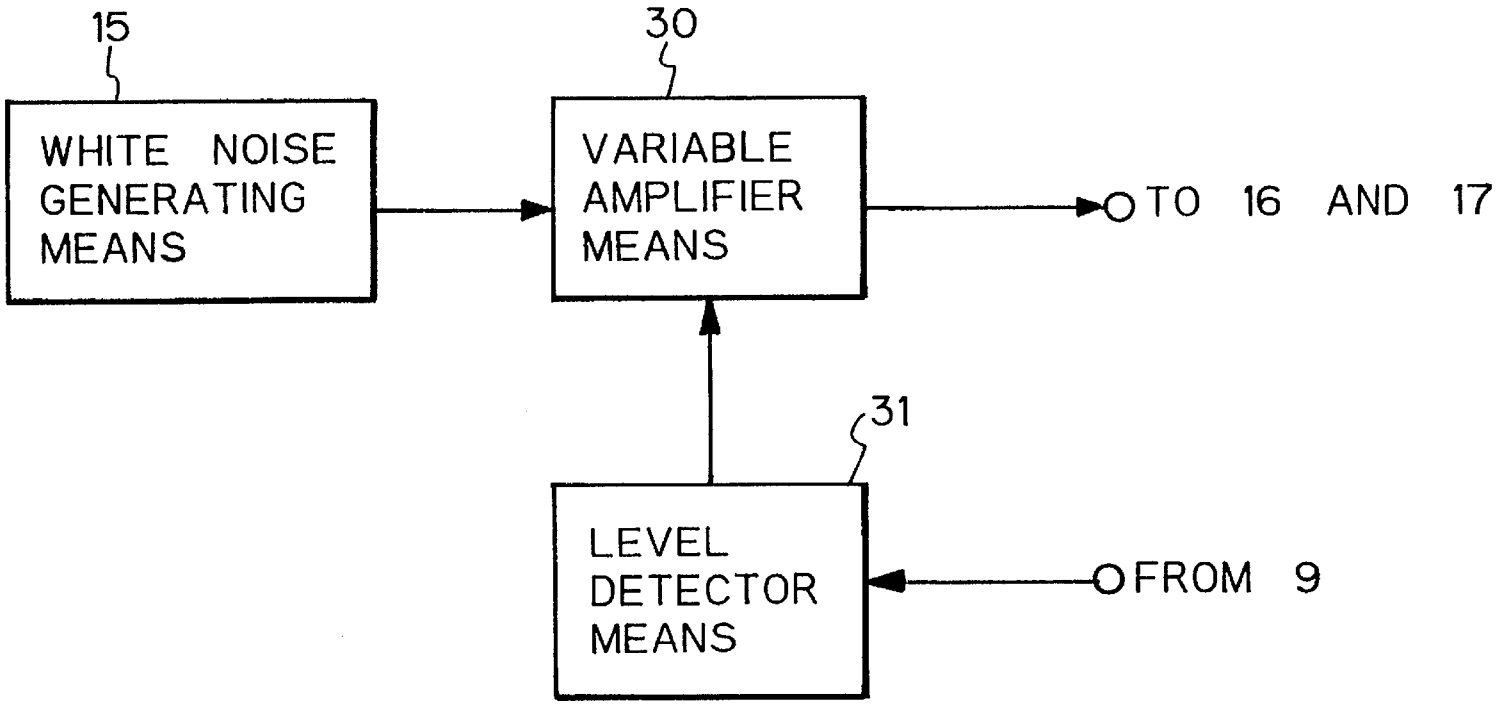
FIG. 6 is a diagram illustrating a portion of the noise controller according to a second embodiment of the present invention.

FIG. 6 is a diagram illustrating a portion of the noise controller according to a second embodiment of the present invention. The noise controller shown in FIG. 6 includes a variable amplifier means 30 which variably amplifies the output signal of the white noise generating means 15 and a noise level detector means 31 which detects the level of the output signals of the A/D converter 9 and controls the amount of amplification of the variable amplifier means 30, which is provided between the white noise generating means 15 and the switching means 16, 17 and 21. According to this embodiment, the level detector means 31 detects the noise amplification level prior to generating an equalization signal, outputs an equalization signal maintaining a level greater than the above level, and outputs a signal greater than the noise in order to improve the accuracy of equalization and the accuracy of equalization judgement. The above-mentioned method is effective when the noise level is great to some extent. When the noise level is too great, however, a predetermined limitation is imposed on the amplification degree of the variable amplifier means 30. Described below is an initial equalization that can be set even under such conditions.

Figure 7:
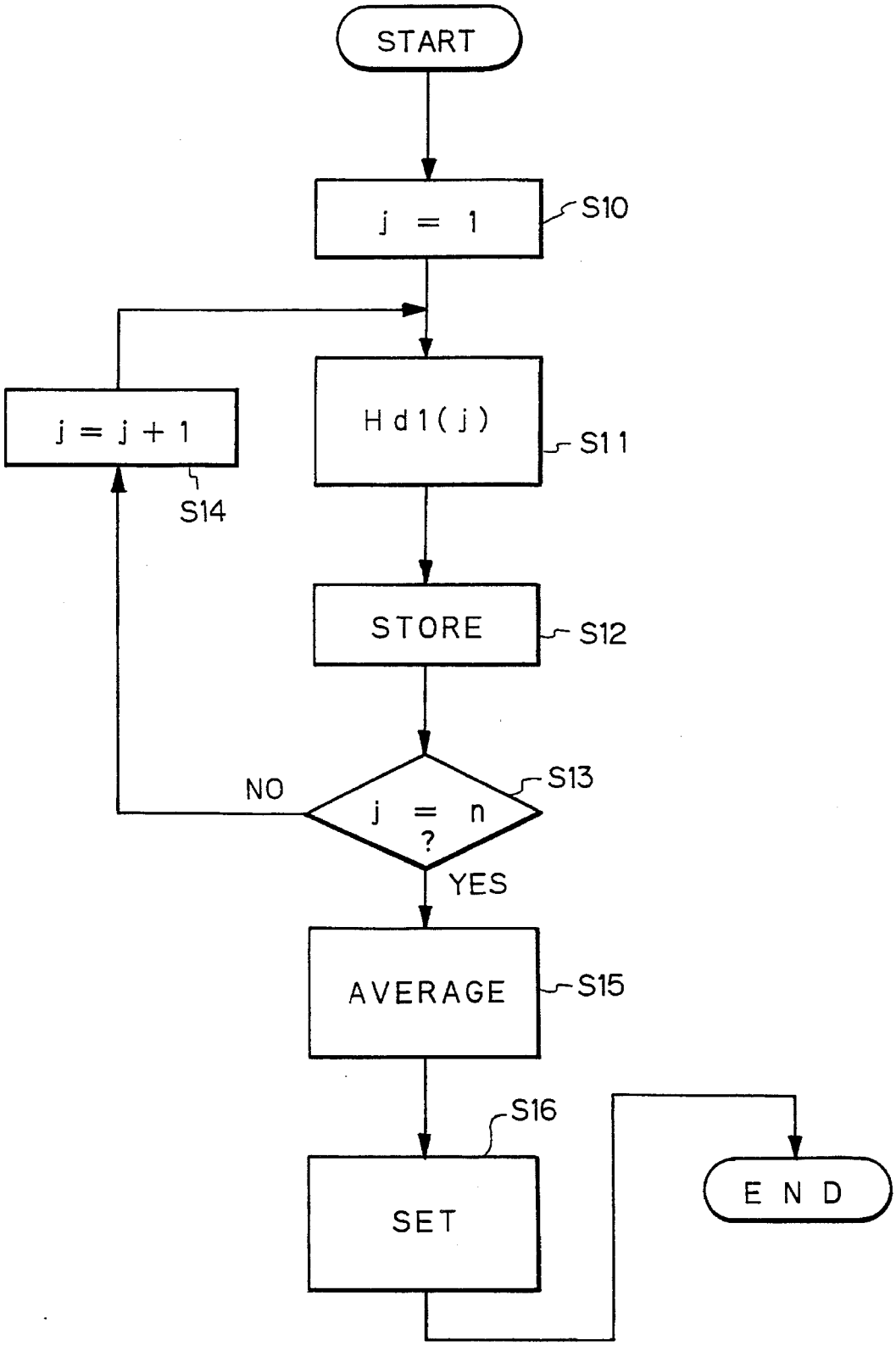
FIG. 7 is a flowchart which explains a process of the initial equalization under noisy conditions according to a third embodiment of the present invention.

FIG. 7 is a flowchart which explains a process of the initial equalization under noisy conditions according to a third embodiment of the present invention. As shown in FIG. 7, a step 10 sets an ordinal number to j=1.

A step 11 measures simulated transfer characteristics Hd1(j) with which the output signal Swe of the differential signal calculation means 14 of FIG. 4 becomes the smallest. Here, a feature of this embodiment is utilization of the fact that there is no correlation between the white noise signal from the white noise generating means 15 and the noise. That is, though the simulated transfer characteristics are affected by noise and do not remain constant for each measurement, there is no correlation to the noise if several measurements are averaged. Therefore, transfer characteristics are obtained based only upon criterion signals of white noise.

A step 12 stores Hdl(j) in a storage unit that is not shown.

A step 13 judges whether the number of measurement times j has reached a predetermined number of times n.

When the number of measurements has not reached the predetermined number of times in the step 13, a step 14 increases the ordinal number and brings the routine back to the step 11.

When the number of measurements has reached a predetermined number of times in the step 13, a step 15 reads the simulated transfer characteristics Hd1(j) (j=1 to n) stored in the step 12 and averages them as follows:

$$Hd1=\{Hd1(1)+Hd1(2)+\ldots+Hd1(n)\}/n \quad (13)$$

A step 16 sets the simulated transfer characteristics obtained in the step 15 to the first simulated transfer characteristics compensation means 12.

According to the present invention as described above, when the white noise signal from the white noise generating means is selected by the initial equalization judging means as a criterion noise signal, the accuracy of the initial equalization is checked relying upon the S/N ratio of the error signal and the criterion noise signal, and this result is indicated. If the noise controller itself, the speaker, microphone or the like becomes defective, therefore, the accuracy of the initial equalization is conspicuously deteriorated and can, therefore, be easily detected.

Figure 8:
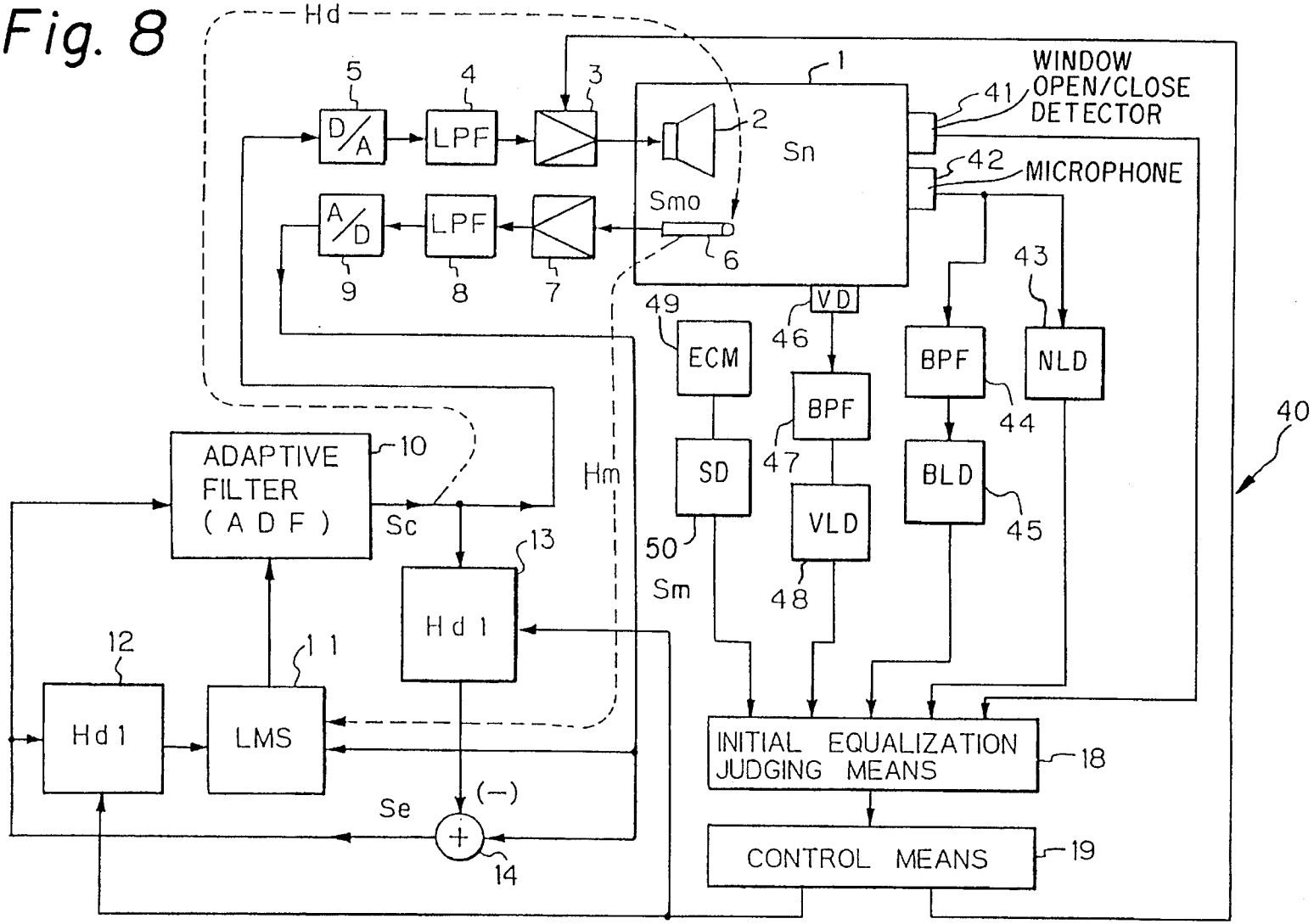
FIG. 8 is a diagram showing a noise controller according to a fourth embodiment of the present invention.

FIG. 8 is a diagram illustrating a noise controller according to a fourth embodiment of the present invention. As shown in FIG. 8, the noise controller includes a first simulated transfer characteristics compensation means 12 consisting of an FIR filter which sets the initial equalization by simulating the transfer characteristics of a transmission path from the output of the adaptive filter 10 through to the input of the coefficient updating means 11 via the speaker 2, microphone 1 and the line, and forms a reproduced reference signal by synthesizing the cancelling signal and the error signal together, a second simulated transfer characteristics compensation means 13 which is constituted in the same manner as the first simulated transfer characteristics compensation means 12 and subjects the error signal input to the coefficient updating means to the initial equalization, and a differential signal calculation means 14 which calculates a difference between an output signal from the second simulated transfer characteristics compensation means 13 and an output signal from the A/D converter to form a reproduced reference signal Se which is to be output to the adaptive filter 10 and to the first simulated transfer characteristics compensation means 12.

And the noise controller includes an initial equalization change detector means 40 which detects the condition where operation of the noise controller itself is not requested, instead of including the white noise generating means 15 and the switches 16, 17 and 21 of FIG. 1. The initial equalization change detector means 40 comprises a window open/close detector 41 which detects whether the window is opened or is closed when the closed space 1 is, for example, a vehicle room, a microphone 42 which detects the sound pressure level in the closed space 1, a noise level detector (NLD) 43 which detects whether the noise level is smaller than a predetermined value relying upon the microphone 42, a band-pass filter (BPF) 44 which only picks up signals of a desired frequency band (e.g., 100 Hz to 500 Hz) from the output signals of the microphone 42, a band level detector (BLD) 45 which detects the output level of the band pass filter 44, a vibration detector (VD) 46 installed in the closed space, a band pass filter (BPF) 47 which only picks up signals of a desired frequency band (e.g., 100 Hz to 1 KHz) from the output signals of the vibration detector 46, a vibration level detector (KD) 48 which detects the output level of the band-pass filter 47, a speed detector (SD) 50 for detecting the speed which is used for, for example, an engine control means (ECM) 49 that moves the closed space 1, an initial equalization judging means 18 which receives the outputs of the window open/close detector 41, noise level detector 43, band level detector 45, vibration level detector 48 and speed detector 50, and judges a change in the initial equalization.

The control unit 19 that inputs data from the initial equalization means 18 controls the muting for the power amplifier 3, controls the coefficient of the coefficient updating means 11, and controls the first simulated transfer characteristics compensation means 12 and of the second simulated transfer characteristics compensation means 13 based on the judgment of the initial equalization judging means 18 Next, an OFF control means 31 will be described.

Figure 9:
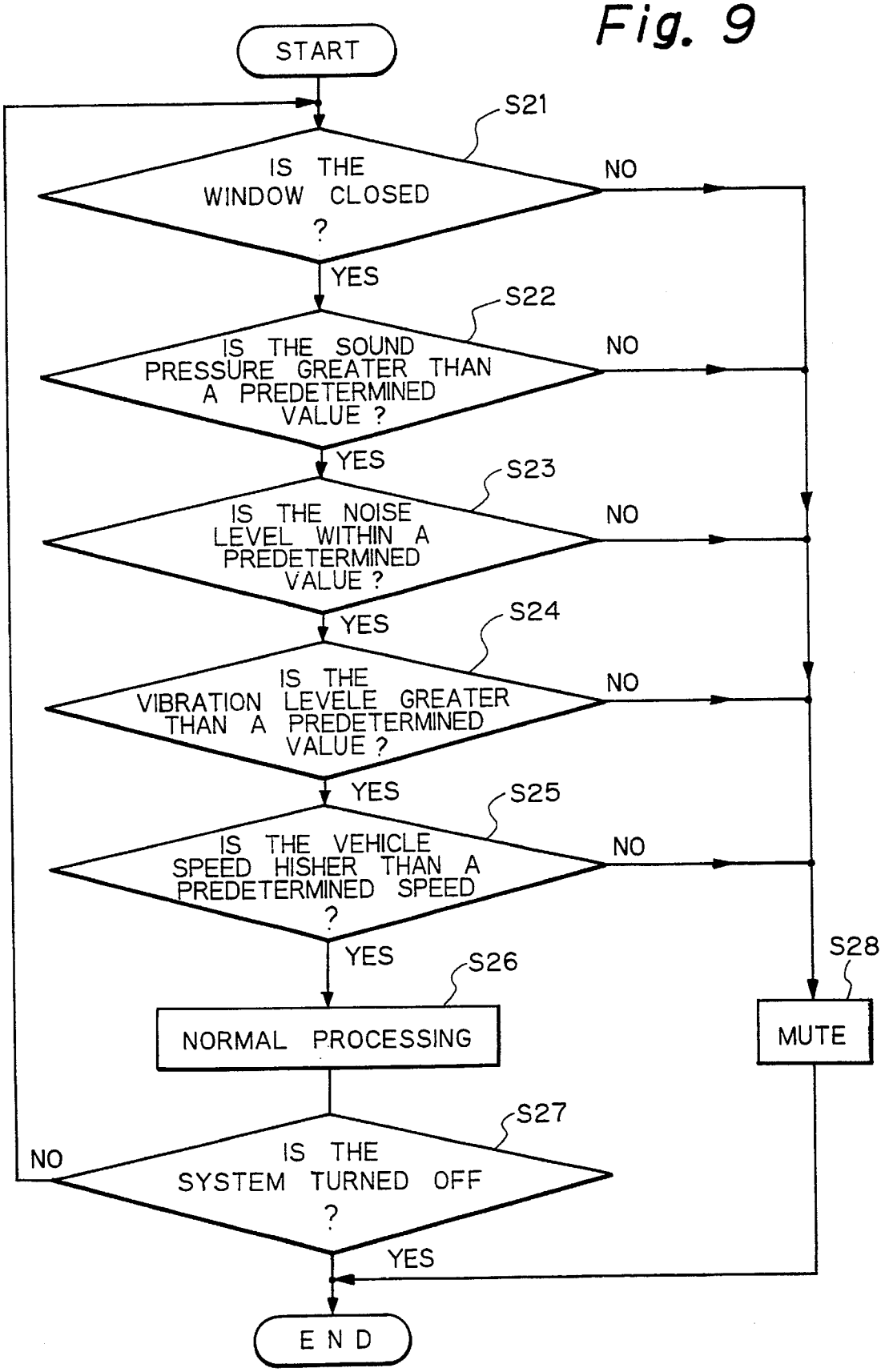
FIG. 9 is a flowchart which explains the operation of an OFF control means of FIG. 8.

FIG. 9 is a flowchart for explaining the operation of the OFF control means of FIG. 8. As shown in FIG. 9, a step 21 judges whether the window is opened or is closed in response to a signal from the window open/close detector 41. The initial equalization is usually accomplished with the window closed. With the window opened, therefore, the transfer characteristics undergo a change in the vehicle room. Therefore, when it is judged based on a signal from the window open/close detector 41 that the window is opened, the routine proceeds to a step 28 which causes, for example, the power amplifier 3 to be muted, whereby the speaker 2 stops outputting the sound and, therefore, the noise controller is turned off.

When it is judged in the step 21 that the window is closed, the noise level detector 43 judges in a step 22 whether the sound pressure in the closed space 1 is smaller than a predetermined value. In this case, the noise controller does not need to be operated and therefore, is turned off in the same manner as described above.

When the sound pressure is greater than the predetermined value in the step 22, the band level detector 45 judges in a step 23 whether the noise level of a predetermined frequency band is greater than a predetermined value or not. This is because the frequency of noise that is to be cancelled must be emphasized. When the noise of such a frequency band has a level greater than the predetermined value, the noise controller is turned off in the same manner as described above. This is to prevent erroneous operation in the low-frequency zone where the microphone exhibits poor output efficiency and in the high-frequency zone where the noise is difficult to cancel.

In a step 24, the vibration level detector 48 judges whether the vibration level of a predetermined frequency band is greater than a predetermined value or not. This is advantageous when the noise level cannot be detected by the band level detector 45. Since vibration of an engine, motor or the like can be directly measured, the frequency can be detected without being affected by the speaker 2. When there exists vibration which is greater than a predetermined value within a predetermined frequency band, the noise controller is turned off in the same manner as described above.

In a step 25, the speed detector 40 judges whether the vehicle speed is high or low. When the speed is high (e.g., higher than 80 Km/h), the sound produced by wind whistle increases though it is different from target noise. Therefore, the noise controller is turned off in the same manner as described above.

In a step 26, normal noise control operation is carried out except when the operation is not required or when erroneous operation is likely to take place as described above.

In a step 27, the aforementioned operation is repeated until the noise controller is turned off for some other reason. Though the above-mentioned steps are arranged in series, these steps may be provided alone or in any combination. According to the present invention as described above, any change in the initial equalization is detected to preclude operation which is different from the one under the aforementioned conditions of initial equalization, and the opposite phase and the equal sound pressure are no longer generated upon the detection of this change. When the noise controller is used under different conditions and is deviated from the initial equalization, the deviation is detected and its operation is stopped to prevent the occurrence of abnormal operation.

In the foregoing the case was described where predetermined simulated transfer characteristics are set in the first simulated transfer characteristics compensation means 12 and to the second simulated transfer characteristics compensation means 13 when the closed space 1 is placed under predetermined conditions. It is, however, also allowable to change the simulated transfer characteristics of the first simulated transfer characteristics compensation means 12 and of the second simulated transfer characteristics compensation means 13 depending upon the conditions of the closed space 1. For instance, simulated transfer characteristics of the first simulated transfer characteristics compensation means 12 and of the second simulated transfer characteristics compensation means 13 may be formed and stored in the control unit 19 depending upon the combination of operations of the window open/close detector 41, microphone 42, vibration detector 46 and speed detector 50, and the filter coefficients of the first simulated transfer characteristics compensation means 12 and of the second simulated transfer characteristics compensation means 13 may be updated based upon the operations of the above-mentioned detectors. Since the initial equalization can be thus changed, the noise controller does not need to be undesirably stopped.

We claim:

1. A noise controller which generates a cancelling sound having a phase opposite to and a sound pressure equal to those of a noise, comprising:

an adaptive filter which inputs a standard signal based on a type of said noise, varies a filter coefficient to cancel said noise, and outputs a cancelling signal for generating said cancelling sound;

coefficient updating means which updates the filter coefficient of the adaptive filter in order to minimize a level of an error sound remaining after the noise is cancelled by the cancelling sound;

simulated transfer characteristics compensation means which inputs the standard signal and outputs an initial equalization signal to the coefficient updating means for simulating transfer characteristics of a transmission path between an output of the adaptive filter and an input of the coefficient updating means, the transmission path including a space in which the noise is cancelled, and which provides initial equalization for the standard signal which is input to the adaptive filter;

white noise generating means for generating a white noise signal as a test signal for checking said initial equalization;

initial equalization judging means which evaluates and judges an accuracy of the initial equalization signal based on a ratio of an error signal, which corresponds to the error sound remaining in said space when said white noise signal is said cancelling signal, and a reproduced reference signal, which is obtained by synthesizing the cancelling signal output by said adaptive filter and said error signal when said white noise signal is said standard signal;

a first switch for switching an input of said adaptive filter between the standard signal and said white noise signal output by said white noise generating means;

a second switch for switching an input of a speaker outputting the cancelling sound between said cancelling signal output by said adaptive filter and said white noise signal output by said white noise generating means; and a third switch for switching an input of said coefficient updating means between an output of a microphone detecting said error sound and generating said error signal and said reproduced reference signal.

2. A noise controller which generates a cancelling sound having a phase opposite to and a sound pressure equal to those of a noise, comprising:

an adaptive filter which inputs a standard signal based on a type of said noise, varies a filter coefficient to cancel said noise, and outputs a cancelling signal for generating said cancelling sound;

coefficient updating means which updates the filter coefficient of the adaptive filter in order to minimize a level of an error sound remaining after the noise is cancelled by the cancelling sound;

simulated transfer characteristics compensation means which inputs the standard signal and outputs an initial equalization signal to the coefficient updating means for simulating transfer characteristics of a transmission path between an output of the adaptive filter and an input of the coefficient updating means, the transmission path including a space in which the noise is cancelled, and which provides initial equalization for the standard signal which is input to the adaptive filter;

a speaker which inputs the cancelling signal and generates the cancelling sound;

a microphone which detects the error sound and generates an error signal;

storage noise generating means for inputting and storing a noise signal output by the microphone, the microphone detecting the noise and outputting the noise signal when said cancelling sound is not generated by the speaker, and for outputting the stored noise signal as a test signal for checking said initial equalization; and initial equalization judging means which evaluates and judges an accuracy of the initial equalization signal based on a ratio of an error signal, which corresponds to the error sound remaining in said space when said stored noise signal is said cancelling signal, and a reproduced reference signal, which is obtained by synthesizing the cancelling signal output by said adaptive filter and said error signal when said stored noise signal is said standard signal.

3. A noise controller which generates a cancelling sound having a phase opposite to and a sound pressure equal to those of a noise, comprising:

an adaptive filter which inputs a standard signal based on a type of said noise, varies a filter coefficient to cancel said noise, and outputs a cancelling signal for generating said cancelling sound;

coefficient updating means which updates the filter coefficient of the adaptive filter in order to minimize a level of an error sound remaining after the noise is cancelled by the cancelling sound;

simulated transfer characteristics compensation means which inputs the standard signal and outputs an initial equalization signal to the coefficient updating means for simulating transfer characteristics of a transmission path between an output of the adaptive filter and an input of the coefficient updating means, the transmission path including a space in which the noise is cancelled, and which provides initial equalization for the standard signal which is input to the adaptive filter;

white noise generating means for generating a white noise signal as a test signal for checking said initial equalization;

initial equalization judging means which evaluates and judges an accuracy of the initial equalization signal based on a ratio of an error signal, which corresponds to the error sound remaining in said space, when said white noise signal is said cancelling signal, and a reproduced reference signal, which is obtained by synthesizing the output signal of said adaptive filter and said error signal when said white noise signal is said standard signal;

a speaker which inputs the cancelling signal and generates the cancelling sound;

a microphone which detects the error sound and generates an error signal;

noise level detector means for detecting a level of said error signal; and variable amplifier means, which inputs said white noise signal, for variably amplifying an output level of said white noise signal based on the detected level of said error signal.

4. A noise controller which generates a cancelling sound having a phase opposite to and a sound pressure equal to those of a noise infiltrating into a closed space, comprising:

an adaptive filter which inputs a standard signal based on a type of said noise, varies a filter coefficient to cancel said noise, and outputs a cancelling signal for generating said cancelling sound;

coefficient updating means which updates the filter coefficient of the adaptive filter based on an error sound remaining after the noise has been cancelled by the cancelling sound;

first simulated transfer characteristics compensation means which inputs the standard signal and outputs a first initial equalization signal to the coefficient updating means for simulating transfer characteristics of a transmission path between an output of the adaptive filter and an input of the coefficient updating means, the transmission path including a space in which the noise is cancelled, and which provides first initial equalization for the standard signal which is input to the adaptive filter;

second simulated transfer characteristics compensation means which inputs the cancelling signal output by the adaptive filter and outputs a second initial equalization signal for simulating transfer characteristics of a transmission path between an output of the adaptive filter and an input of the coefficient updating means, the transmission path including a space in which the noise is cancelled, to form a reproduced reference signal, which is obtained by synthesizing the second initial equalization signal and an error signal corresponding to the error sound, the reproduced reference signal being input to the first simulated transfer characteristics compensation means;

initial equalization conditions change detector means for detecting a change in conditions of the closed space, said first and second simulated transfer characteristics compensation means determining the first and second initial equalizations based on the conditions of the closed space; and initial equalization judging means for judging an accuracy of the first and second initial equalizations based upon the detected change in the conditions of the closed space.

5. A noise controller according to claim 4, wherein said initial equalization change detector means comprises a window open/close detector which detects whether a window of said closed space is opened or closed and outputs a change in initial equalization signal to the initial equalization judging means when the window is opened.

6. A noise controller according to claim 4, wherein said initial equalization change detector means comprises at least one noise level detector, each at least one noise level detector detecting a noise level in said closed space and outputting a change in initial equalization signal to the initial equalization judging means when the noise level is outside of a predetermined range.

7. A noise controller according to claim 4, wherein said initial equalization change detector means comprises at least one band noise level detector, each at least one band noise level detector detecting a noise level of only a desired frequency band in said closed space, and outputting a change in initial equalization signal to the initial equalization judging means when the noise level of the desired frequency band is outside of a predetermined range.

8. A noise controller according to claim 4, wherein said initial equalization change detector means comprises at least one vibration level detector, each at least one vibration level detector detecting vibration that is a cause of noise in said closed space, and outputting a change in initial equalization signal to the initial equalization judging means when the vibration level of a desired vibration frequency is outside of a predetermined range.

9. A noise controller according to claim 4, wherein said initial equalization change detector means comprises a speed detector which detects a movement speed when said closed space undergoes a movement, and outputs a change in initial equalization signal to the initial equalization judging means when the speed is outside of a predetermined range.

10. The noise controller of claim 1, further comprising control means for controlling the simulated transfer characteristics compensation means based on a judgment by the initial equalization judging means, wherein, when the initial equalization judging means judges the accuracy of the initial equalization signal is outside of a predetermined range, the control means controls the simulated transfer characteristics compensation means to determine a new initial equalization signal.

11. The noise controller of claim 2, further comprising control means for controlling the simulated transfer characteristics compensation means based on a judgment by the initial equalization judging means, wherein, when the initial equalization judging means judges the accuracy of the initial equalization signal is outside of a predetermined range, the control means controls the simulated transfer characteristics compensation means to determine a new initial equalization signal.

12. The noise controller of claim 3, further comprising control means for controlling the simulated transfer characteristics compensation means based on a judgment by the initial equalization judging means, wherein, when the initial equalization judging means judges the accuracy of the initial equalization signal is outside of a predetermined range, the control means controls the simulated transfer characteristics compensation means to determine a new initial equalization signal.

13. The noise controller of claim 4, further comprising control means for controlling the simulated transfer characteristics compensation means based on a judgment by the initial equalization judging means, wherein, when the initial equalization judging means judges the accuracy of the initial equalization signal is outside of a predetermined range, the control means controls the simulated transfer characteristics compensation means to determine a new initial equalization signal.

* * * * *